US009400464B2

(12) United States Patent
Utsunomiya et al.

(10) Patent No.: US 9,400,464 B2
(45) Date of Patent: Jul. 26, 2016

(54) FIXING DEVICE AND IMAGE FORMING APPARATUS

(71) Applicants: Kohichi Utsunomiya, Kanagawa (JP); Hideo Nagafuji, Kanagawa (JP); Yuji Arai, Kanagawa (JP); Arinobu Yoshiura, Kanagawa (JP); Shohei Saito, Kanagawa (JP); Qifeng Cui, Tokyo (JP); Yutaka Ikebuchi, Kanagawa (JP); Motoyoshi Yamano, Kanagawa (JP)

(72) Inventors: Kohichi Utsunomiya, Kanagawa (JP); Hideo Nagafuji, Kanagawa (JP); Yuji Arai, Kanagawa (JP); Arinobu Yoshiura, Kanagawa (JP); Shohei Saito, Kanagawa (JP); Qifeng Cui, Tokyo (JP); Yutaka Ikebuchi, Kanagawa (JP); Motoyoshi Yamano, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/793,949

(22) Filed: Jul. 8, 2015

(65) Prior Publication Data

US 2016/0011550 A1 Jan. 14, 2016

(30) Foreign Application Priority Data

Jul. 10, 2014 (JP) ..... 2014-142591

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 2215/2035; G03G 15/2064; G03G 15/2017; G03G 15/2085
USPC ..... 399/329
See application file for complete search history.

(56) References Cited

U.S. PATENT DOCUMENTS

| | | | | |
|---|---|---|---|---|
| 5,499,087 | A * | 3/1996 | Hiraoka | G03G 15/2064 219/216 |
| 2006/0216078 | A1* | 9/2006 | Higashi | G03G 15/2057 399/333 |
| 2007/0189818 | A1 | 8/2007 | Kondo et al. | |
| 2007/0292175 | A1 | 12/2007 | Shinshi | |
| 2010/0290822 | A1* | 11/2010 | Hasegawa | G03G 15/2064 399/329 |

(Continued)

FOREIGN PATENT DOCUMENTS

| | | |
|---|---|---|
| JP | 2007-233011 | 9/2007 |
| JP | 2007-334205 | 12/2007 |

OTHER PUBLICATIONS

U.S. Appl. No. 14/790,297, filed Jul. 2, 2015, Utsunomiya, et al.

(Continued)

*Primary Examiner* — Walter L Lindsay, Jr.
*Assistant Examiner* — Frederick Wenderoth
(74) *Attorney, Agent, or Firm* — Oblon, McClelland, Maier & Neustadt, L.L.P.

(57) ABSTRACT

A fixing device includes an endless fixing belt, fixing-belt holding members which hold the fixing belt at opposite ends, a pressure member to be brought into contact with the fixing belt, a nip forming member arranged inside the fixing belt to form a nip area by contacting the pressure member with the fixing belt, a nip supporting member, side plates where the fixing-belt holding members and the nip supporting member are fixed, and a pressing mechanism which presses the pressure member against the nip forming member. The nip forming member includes at least three layers including a heat absorbing layer contacting the nip supporting member. With no load applied, the nip supporting member assumes a shape protruding at longitudinal center toward the pressure member and is in contact with the nip forming member while having the shape protruding at the center portion.

7 Claims, 11 Drawing Sheets

(56) References Cited

U.S. PATENT DOCUMENTS

| | | | |
|---|---|---|---|
| 2011/0058866 | A1 | 3/2011 | Ishii et al. |
| 2011/0076071 | A1 | 3/2011 | Yamaguchi et al. |
| 2011/0116848 | A1 | 5/2011 | Yamaguchi et al. |
| 2011/0129268 | A1 | 6/2011 | Ishii et al. |
| 2011/0194870 | A1 | 8/2011 | Hase et al. |
| 2011/0200368 | A1 | 8/2011 | Yamaguchi et al. |
| 2011/0206427 | A1 | 8/2011 | Iwaya et al. |
| 2011/0217093 | A1 | 9/2011 | Tokuda et al. |
| 2011/0217095 | A1 | 9/2011 | Ishii et al. |
| 2011/0222888 | A1 | 9/2011 | Ikebuchi et al. |
| 2011/0222929 | A1 | 9/2011 | Fujimoto et al. |
| 2011/0222930 | A1 | 9/2011 | Fujimoto et al. |
| 2011/0229181 | A1 | 9/2011 | Iwaya et al. |
| 2011/0229225 | A1 | 9/2011 | Ishii et al. |
| 2011/0229226 | A1 | 9/2011 | Tokuda et al. |
| 2011/0229227 | A1 | 9/2011 | Yoshikawa et al. |
| 2011/0229228 | A1 | 9/2011 | Yoshikawa et al. |
| 2011/0274453 | A1 | 11/2011 | Shimokawa et al. |
| 2012/0121305 | A1 | 5/2012 | Yoshikawa et al. |
| 2012/0155936 | A1 | 6/2012 | Yamaguchi et al. |
| 2012/0177423 | A1 | 7/2012 | Imada et al. |
| 2013/0045032 | A1 | 2/2013 | Shimokawa et al. |
| 2013/0170879 | A1 | 7/2013 | Yoshinaga et al. |
| 2013/0170880 | A1 | 7/2013 | Gotoh et al. |
| 2013/0183071 | A1 | 7/2013 | Iwaya et al. |
| 2013/0195493 | A1 | 8/2013 | Hase et al. |
| 2013/0209125 | A1 | 8/2013 | Uchitani et al. |
| 2013/0251390 | A1 | 9/2013 | Ishii et al. |
| 2014/0064804 | A1 | 3/2014 | Yamaguchi et al. |
| 2014/0072355 | A1 | 3/2014 | Tamaki et al. |
| 2014/0079424 | A1 | 3/2014 | Ikebuchi et al. |
| 2014/0079453 | A1 | 3/2014 | Arai et al. |
| 2014/0079455 | A1 | 3/2014 | Seki et al. |
| 2014/0248072 | A1 | 9/2014 | Yoshinaga et al. |
| 2014/0270820 | A1 | 9/2014 | Saito et al. |
| 2014/0270832 | A1 | 9/2014 | Saito et al. |
| 2014/0270833 | A1 | 9/2014 | Yuasa et al. |
| 2014/0270872 | A1 | 9/2014 | Tamaki et al. |

OTHER PUBLICATIONS

U.S. Appl. No. 14/792,870, filed Jul. 7, 2015, Utsunomiya, et al.
U.S. Appl. No. 14/790,297, filed Jul. 2, 2015.
U.S. Appl. No. 14/792,870, filed Jul. 7, 2015.
U.S. Appl. No. 14/536,173, filed Nov. 7, 2014.
U.S. Appl. No. 14/657,656, filed Mar. 13, 2015.
U.S. Appl. No. 14/644,903, filed Mar. 11, 2015.

* cited by examiner

FIXING DEVICE AND IMAGE FORMING APPARATUS

CROSS-REFERENCE TO RELATED APPLICATIONS

The present application claims priority to and incorporates by reference the entire contents of Japanese Patent Application No. 2014-142591 filed in Japan on Jul. 10, 2014.

BACKGROUND OF THE INVENTION

1. Field of the Invention

The present invention generally relates to a fixing device and an image forming apparatus.

2. Description of the Related Art

Image forming apparatuses such as copiers, printers, and facsimiles of recent years typically form an image by performing an image forming process which may be electrophotographic recording, electrostatic recording, or magnetic recording. Thereafter, an unfixed toner image is formed on a recording medium such as a recording medium sheet, printing paper, photosensitive paper, or electrostatic recording paper using an image transfer scheme or a direct image formation scheme. Known types of fixing devices for fixing such an unfixed toner image include fixing devices that perform a fixing process by applying heat and pressure to a toner image formed on recording paper in a nip area between an endless belt and a pressure roller.

Known examples of such a fixing device include belt-type fixing devices. For example, a belt-type fixing device may be configured as illustrated in FIG. 10. Referring to FIG. 10, a fixing belt 103 is disposed between a heating roller 104, which internally includes a heater 105, and a fixing roller 102. A pressure roller 101 is pressed against the fixing roller 102 with the fixing belt 103 to form a fixing nip area. A tension is applied from a tension applying unit 107 to the fixing belt 103. A separation claw 106 that strips off a recording sheet P where a toner image is fixed from the fixing belt 103 is arranged. The temperature of the fixing belt 103 on the side of the heating roller 104 is detected using a thermistor 110.

In recent years, there is a desire for further reduction in warm-up time and first print time. The warm-up time refers to the time lapse until the temperature rises at power-on or a like occasion from a room temperature to a predetermined temperature (reload temperature) at which printing can be performed. The first print time refers to the time lapse between receipt of a print request and when a sheet of recording medium, on which printing is performed after making preparation for the printing, is ejected. Furthermore, as the output speed of image forming apparatuses increases, the number of sheets fed per unit time increases, and larger amounts of heat is required. This results in a problem that shortage of heat (which may be generally referred to as temperature drop) occurs in particular at beginning of continuous printing. However, the conventional belt-type fixing device fails to fully solve these problems.

To alleviate the problems, a fixing device of the following type is disclosed. The fixing device uses a pipe-like metal heat conductor disposed inside an endless belt. The metal heat conductor is heated by an internal heat source, and the entire endless belt is heated by convection in an air layer between the endless belt and the metal heat conductor, radiant heat, heat conduction, and the like. An example of this type of fixing device that uses such a pipe-like metal heat conductor is disclosed in Japanese Laid-open Patent Application No. 2007-334205.

The fixing device disclosed in Japanese Laid-open Patent Application No. 2007-334205 further includes a pressure roller that is to be brought into contact with the metal heat conductor with the endless belt therebetween, thereby forming a nip area. The pressure roller is rotated, causing the endless belt to be moved in the circumferential direction relative to the fixed metal heat conductor by rotation of the pressure roller. This configuration allows heating the entire endless belt included in the fixing device, so that first print time from a heating-standby state is reduced and the problem of heat shortage that can occur when the number of fed sheets per unit time is large is alleviated.

An example of a fixing device including only a nip forming member, a backup member, and a heat source inside a loop of an endless belt is disclosed in Japanese Laid-open Patent Application No. 2007-233011. The nip forming member includes a sliding surface that makes sliding contact with the endless belt. The backup member is positioned on the side opposite from the sliding surface of the nip forming member and supports the nip forming member.

This fixing device includes a pressure roller configured to press the sliding surface of the nip forming member with the endless belt therebetween to form a nip area, and cause the endless belt to be rotated in a predetermined direction by rotation of the pressure roller. This fixing device can advantageously reduce heat capacity of the heat source and therearound. Furthermore, because the nip area is formed at a portion where the endless belt is directly heated by the heat source, the first print time from the heating-standby mode can be reduced.

As disclosed in Japanese Laid-open Patent Application No. 2007-233011, in the fixing device including, inside the loop of the endless belt, the nip forming member including the sliding surface that makes sliding contact with the inner surface of the endless belt and the backup member supporting the nip forming member, the backup member should pass through the belt. In the fixing device, a nip supporting member which is the backup member that receives a load applied thereto from the pressure roller via the nip forming member functions as a beam with fixed ends (hereinafter, "fixed-ends beam") that supports the load at its both ends.

Meanwhile, for reduction in size and elimination of unnecessary heat capacity of a fixing device, the smaller the volume of the nip supporting member, the more desirable. However, reducing the volume of the nip supporting member can arise the following problem. Assume that, as illustrated in FIG. 11A, a nip forming member 122 inside a loop of an endless belt 121 is supported by a nip supporting member 123, which is supported at both ends by side plates 125 on an apparatus body. When a pressing force Pr is applied from a pressure roller 124 to the nip supporting member 123 in this state, a center portion of the nip supporting member 123 is warped in a direction (downward in FIG. 11A) away from a nip area N. As the volume of the nip supporting member decreases, rigidity of the nip supporting member 123 decreases, and warping of the nip supporting member 123 increases. As a result, as indicated by the dashed line in FIG. 11B, a width n of the nip area N of the nip forming member 122 decreases at its longitudinal center portion, making a nip width that is accurately uniform in the longitudinal direction of the nip forming member unobtainable.

If a uniform nip width cannot be obtained because the nip width n of the nip forming member 122 varies in the longitudinal direction of the nip forming member 122, stable fixing quality becomes unachievable.

To alleviate this problem, a configuration that compensates for warping of the nip forming member 122 even if the nip forming member 122 is warped by the pressing force Pr applied from the pressure member may be employed. Put another way, a fixing device is desirably configured to obtain a nip width that is accurately uniform in the longitudinal direction of a nip forming member even if the nip forming member that faces a pressure member to form a fixing nip area therebetween is warped by a load applied from the pressure member.

Therefore, it is desirable to provide a fixing device in which a nip forming member can have a nip width that is accurately uniform in the longitudinal direction, thereby providing stable fixing quality, and an image forming apparatus including the fixing device.

SUMMARY OF THE INVENTION

It is an object of the present invention to at least partially solve the problems in the conventional technology.

According to an aspect of the present invention, there is provided a fixing device including: an endless fixing belt; fixing-belt holding members configured to hold the fixing belt at opposite ends of the fixing belt; a pressure member configured to be brought into contact with an outer peripheral surface of the fixing belt; a nip forming member arranged inside the fixing belt and configured to form a nip area by contacting the pressure member with the fixing belt; a nip supporting member configured to support the nip forming member; side plates to which the fixing-belt holding members and the nip supporting member are fixed; and a pressing mechanism configured to press the pressure member against the nip forming member with the fixing belt, the nip forming member being formed by at least three layers including a heat absorbing layer, the heat absorbing layer being made of metal and in contact with the nip supporting member, and in a state where no load is applied to the nip supporting member, the nip supporting member having a shape protruding at a longitudinal center portion than at longitudinal end portions toward the pressure member, and the nip supporting member being in contact with the nip forming member in the shape protruding at the center portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
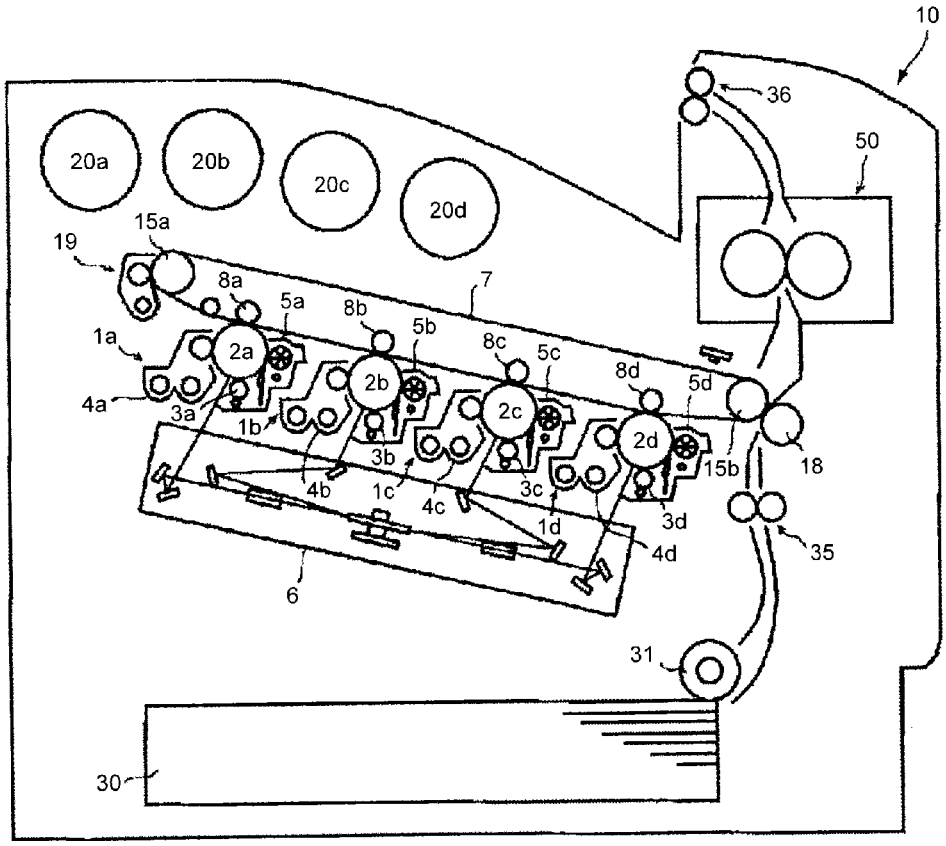
FIG. 1 is a schematic configuration diagram of an image forming apparatus where a fixing device according to a first embodiment of the present invention is mounted.

Exemplary embodiments according to the present invention are described below with reference to the accompanying drawings. In each of the drawings with reference to which the embodiments are described, elements (members, components, or the like) that are identical in function or shape are denoted by like reference numerals so long as they are identifiable, and repeated description is omitted.

FIG. 1 is a schematic cross-sectional view of an example of an image forming apparatus embodied as a color printer where a fixing device according to a first embodiment of the present invention is mounted. An image forming apparatus 10 illustrated in FIG. 1 includes a fixing device 50, which will be described later, and an electrophotographic image forming unit. The image forming unit includes a plurality of (four in the example illustrated in FIG. 1) image forming stations denoted by 1*a*, 1*b*, 1*c*, and 1*d*. The first to fourth image forming stations 1*a*, 1*b*, 1*c*, and 1*d* are identical in configuration except for color of toner to be used. The image forming stations may form a black toner image, a magenta toner image, a cyan toner image, and a yellow toner image, respectively, for example. Because the image forming stations are identical in configuration except for the color of developing agent (toner), characters a, b, c, and d are omitted from reference numerals in the description given below as appropriate.

The image forming unit 1 includes a drum-shaped photoconductor 2 which is an electrostatic-latent-image bearer. A charging member 3, a developing device 4, and a cleaning unit 5 are arranged around the photoconductor 2. The photoconductor 2 is configured to be rotated clockwise. The charging member 3 is pressed against the surface of the photoconductor 2. The charging member 3 is rotated by rotation of the photoconductor 2 when the photoconductor 2 is rotated. The charging member 3, to which a predetermined bias voltage is applied from a high-voltage power supply (not shown), is configured to uniformly deposit charges on the surface of the photoconductor 2 that is rotated. Although a roller-type member in contact with the photoconductor 2 is employed as the charging member 3 illustrated in FIG. 1, a charging member of a non-contact type that utilizes corona discharge or the like may alternatively be employed as the charging member 3.

In the image forming apparatus 10 illustrated in FIG. 1, an exposure device 6 is arranged obliquely below and parallel to the four image forming stations. The exposure device 6 includes elements such as a light source, a polygon mirror, f-θ lenses, and reflecting mirrors as appropriate. The exposure device 6 exposes each of the photoconductors 2 charged by the charging members 3 to light in accordance with image information generated from image data for a corresponding one of the colors of the toner. The exposure device 6 is provided to thus form an electrostatic latent image on each of the photoconductors 2. Each of the electrostatic latent images formed on the photoconductors 2 by the exposure device 6 is developed into a toner image, which is a visible image, with toner of the corresponding color that is applied when the electrostatic latent image is caused to pass through the developing device 4 by rotation of the photoconductor 2. Toner bottles 20*a*, 20*b*, 20*c*, and 20*d* filled with black, magenta, cyan, and yellow toner, respectively, are arranged in an upper portion in the image forming apparatus 10. A predetermined supply amount of toner is supplied from each of the toner bottles 20*a*, 20*b*, 20*c*, and 20*d* to a corresponding one of the developing devices 4*a*, 4*b*, 4*c*, and 4*d* for the respective colors via a delivery passage (not shown).

An endless-belt-type intermediate transfer belt 7, which is an intermediate transfer member, is arranged facing the photoconductors 2 of the image forming stations. Each of the photoconductors 2 is in contact with a front surface (on the outer side of a loop) of the intermediate transfer belt 7. The intermediate transfer belt 7 illustrated in FIG. 1 is stretched around a plurality of support rollers (e.g., support rollers 15*a* and 15*b*). In the example illustrated in FIG. 1, the support roller 15*a* is coupled to a drive motor (not shown) which is a drive source. When the drive motor is driven, the intermediate transfer belt 7 is revolved counterclockwise in FIG. 1, and the support roller 15*b* configured to be rotatable is rotated by the revolving motion. Primary transfer rollers 8 are arranged on a back surface (on the inner side of the loop) of the intermediate transfer belt 7 and positioned to face the photoconductors 2 with the intermediate transfer belt 7 therebetween. A primary transfer bias is applied from a high-voltage power supply (not shown) to the primary transfer roller 8 to perform a primary transfer process of transferring the toner image developed by the developing device 4 onto the intermediate transfer belt 7. Meanwhile, primary-transfer residual toner that is left on the photoconductor 2 without being transferred in the primary transfer process is removed by the cleaning unit 5 to prepare for a next image forming sequence performed using the photoconductor 2. Toner on the photoconductor 2 is thus completely removed.

In the image forming apparatus 10 illustrated in FIG. 1, a secondary transfer roller 18, which is a secondary transfer unit, is disposed downstream, in the direction in which the intermediate transfer belt 7 is revolved, of the primary transfer rollers 8. The secondary transfer roller 18 faces the support roller 15*b* with the intermediate transfer belt 7 therebetween. The secondary transfer roller 18 and the support roller 15*b* form a secondary-transfer nip area with the intermediate transfer belt 7 therebetween. The image forming apparatus 10 includes, in addition to a paper feeding cassette 30, which is a recording-medium container, and a feeding roller 31, a pair of registration rollers 35. The image forming apparatus 10 includes the fixing device 50 and a pair of paper ejection rollers 36 downstream, in a conveying direction of a recording medium, from the secondary transfer roller 18.

An image forming sequence is described below. Elements involved in the image forming sequence including forming a toner image on each of the photoconductors 2 and transferring the toner image onto the intermediate transfer belt 7 are all substantially identical except for the color of the toner image. Accordingly, the characters a, b, c, and d are omitted from reference numerals as appropriate.

The surface of the photoconductor 2 described above is irradiated with light by a neutralizing device (not shown) while the photoconductor 2 is rotated clockwise by the drive source (not shown). Hence, surface potential of the photoconductor 2 is initialized. The surface of the photoconductor 2, the surface potential of which is initialized, is then uniformly charged to a predetermined polarity by the charging member 3. The charged photoconductor surface is irradiated with laser light by the exposure device 6. As a result, an electrostatic latent image is formed on the photoconductor surface. Meanwhile, each of the photoconductors 2 is exposed to the laser light in accordance with mono-color image information obtained by separating colors of a desired full-color image into image information of the respective toner colors: yellow, cyan, magenta, and black. Toner (developing agent) of the corresponding color is applied by the developing device 4 onto the electrostatic latent image formed on the photoconductor 2 as described above when the electrostatic latent image passes through the developing device 4. The electrostatic latent image is thus developed into a visible, toner image.

The intermediate transfer belt 7 is driven to revolve counterclockwise in FIG. 1. A primary transfer voltage of polarity opposite to the polarity of the charged toner of the toner image formed on the photoconductor 2 is applied to the primary transfer roller 8 described above. As a result, a transfer electric field is induced between the photoconductor 2 and the intermediate transfer belt 7. Thereafter, the primary transfer process of electrostatically transferring the toner image on the photoconductor 2 onto the intermediate transfer belt 7 that is revolved in synchronization with the photoconductor 2 is performed. The toner images of the respective colors transferred through the primary transfer process described above are superimposed on one another on the intermediate transfer belt 7 one by one, each at an appropriate time, from upstream in the conveying direction of the intermediate transfer belt 7, thereby forming desired a full-color image.

At the same time, a sheet, on which the image is to be formed, of recording medium is separated from a bundle of recording medium sheets placed on the paper feeding cassette 30 and fed to the pair of registration rollers 35 by the feeding roller 31 and other conveying members as appropriate. During this feeding, registration of the recording medium is performed by bringing a leading end of the conveyed recording medium into contact with a nip area between the pair of registration rollers 35 that has not started rotating yet so that the sheet forms what may generally be referred to as "registration loop".

Thereafter, rotation of the registration rollers 35 is started timed to coincide with the full-color toner image borne on the intermediate transfer belt 7. The recording medium is conveyed to the secondary-transfer nip area formed between the support roller 15*b* and the secondary transfer roller 18 facing the support roller 15*b* with the intermediate transfer belt 7 therebetween. In the first embodiment, a transfer voltage of polarity opposite to the polarity of charged toner of the toner image on the intermediate-transfer-belt surface is applied to the secondary transfer roller 18. Hence, the mono-color toner images superimposed to form the full-color toner image on the surface of the intermediate transfer belt 7 are collectively transferred onto the recording medium.

The recording medium onto which the toner image is transferred is further conveyed to the fixing device 50. Heat and pressure applied to the toner image when the recording medium passes through the fixing device 50 fix the toner image onto the recording medium as a permanent image. The recording medium where the image is formed and fixed is ejected onto a recording-medium ejection unit such as an ejection tray via the pair of paper ejection rollers 36. The image forming sequence is thus completed. An intermediate-transfer-belt cleaning unit 19 removes and collects residual toner left on the intermediate transfer belt 7 without being transferred at the secondary-transfer nip area where the secondary transfer roller 18 is arranged.

Figure 2:
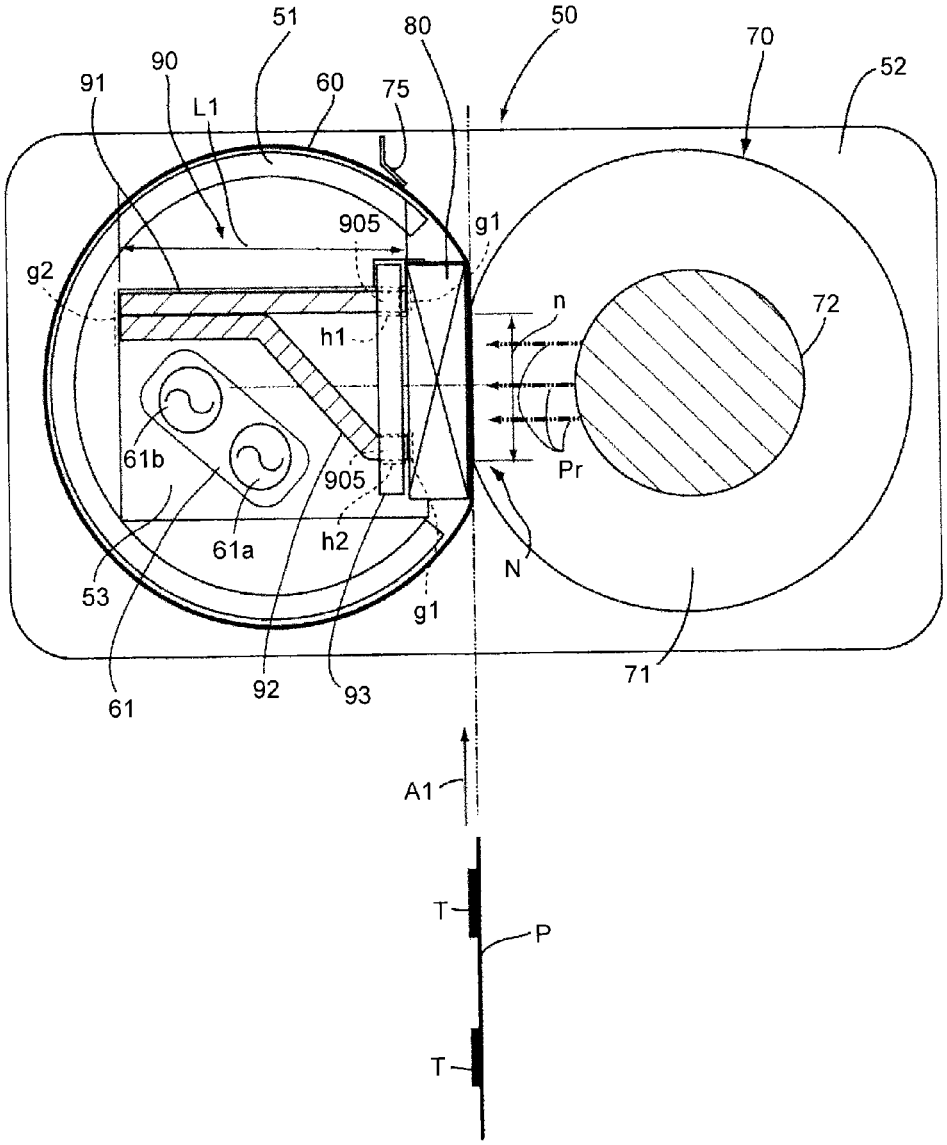
FIG. 2 is an enlarged schematic cross-sectional view of the fixing device illustrated in FIG. 1.

A configuration of the fixing device 50 is described below with reference to FIG. 2. As illustrated in FIG. 2, the fixing device 50 includes a fixing belt 60, which is a fixing member configured to be rotatable, and a pressure roller 70, which is a pressure member configured to be rotatable in contact with the outer peripheral surface of the fixing belt 60. The fixing belt 60 further includes, inside a loop of the fixing belt 60, halogen heaters 61, which are a heat source that heats the fixing belt 60, a pad 80, which is a nip forming member arranged to face the pressure roller 70, and a supporting member 90, which is a nip supporting member supporting the pad 80. The fixing device 50 further includes side plates 52, to which holders 51 and the supporting member 90 are fixed, a temperature sensor (not shown), which is a temperature detector that detects the temperature of the fixing belt 60, and an urging unit (not shown) that urges the pressure roller 70 against the fixing belt 60 to form the nip area N.

The fixing belt 60 is a thin, flexible endless belt member (which can be a film). More specifically, the fixing belt 60 includes a base material, which is on a radially inner side of the fixing belt 60, made of a metal material such as nickel or stainless steel or a resin material such as polyimide (PI). The fixing belt 60 further includes a release layer arranged radially outside of the base material and made of tetrafluoroethylene-perfluoroalkylvinylether copolymer (PFA), polytetrafluoroethylene (PTFE), or the like. The fixing belt 60 may further include an elastic layer made of a rubber material such as solid silicone rubber, silicone rubber foam, or a fluororubber between the base material and the release layer.

The pressure roller 70 includes a metal roller core 72, an elastic layer 71 disposed on the surface of the metal roller core 72, and a release layer (not shown) disposed on the surface of the elastic layer 71. The elastic layer 71 is made of silicone rubber foam, solid silicone rubber, fluororubber, or the like. The release layer is made of PFA, PTFE, or the like. The pressure roller 70 is urged against the fixing belt 60 by the urging member (not shown) into contact with the pad (the nip forming member) 80 with the fixing belt 60 therebetween. At a position where the pressure roller 70 is pressed against the fixing belt 60, the elastic layer 71 of the pressure roller 70 is deformed to form the nip area N having a predetermined width. The pressure roller 70 is configured to be driven to rotate by a drive source (not shown) such as a motor included in a printer body. When the pressure roller 70 is driven to rotate, driving power of the pressure roller 70 is transmitted at the nip area N to the fixing belt 60, causing the fixing belt 60 to be rotated by rotation of the pressure roller 70.

Although the pressure roller 70 is a solid roller in the first embodiment, the pressure roller 70 may alternatively be a hollow roller. When a hollow roller is used as the pressure roller 70, a heat source such as a halogen heater may be disposed inside the pressure roller 70. The pressure roller 70 may be configured without the elastic layer. The pressure roller 70 not including the elastic layer is reduced in heat capacity and therefore increased in fixability. However, if the pressure roller 70 is configured as such, minute surface irregularities of the belt may be transferred onto an image when the pressure roller 70 presses unfixed toner to thereby fix the toner, resulting in uneven gloss of a solid image portion of the image. To prevent such uneven gloss, it is desirable that the pressure roller 70 includes the elastic layer of 100 μm or thicker. The elastic layer of 100 μm or thicker can absorb the minute irregularities by elastic deformation of the elastic layer, thereby preventing uneven gloss. Although the elastic layer 71 may be made of solid rubber, if the pressure roller 70 does not have an internal heat source, the elastic layer 71 may be made of rubber foam. Rubber foam is more desirable than solid rubber; this is because rubber foam makes the fixing belt 60 less susceptible to heat loss by increasing heat insulation. Although the fixing member and the pressure member may be configured to press against each other as described above, alternatively, a configuration in which the fixing member and the pressure member are only brought into contact, rather than pressed against, with each other may be employed.

Figure 7:
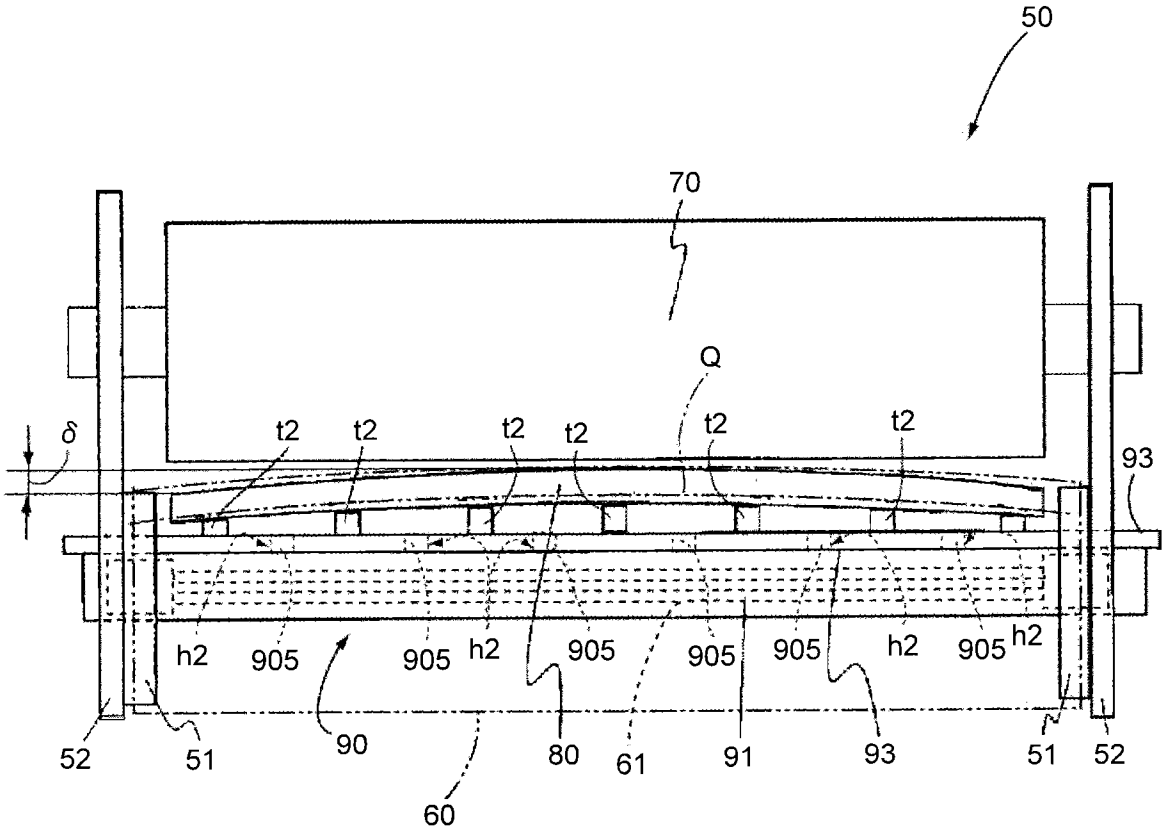
FIG. 7 is a plan view of the relevant portions, from which a fixing belt is removed, of the fixing device illustrated in FIG. 1.

As illustrated in FIG. 7, the pad 80, which is the nip forming member, is arranged to have its longitudinal direction along a rotation axis of the fixing belt 60 or a rotation axis of the pressure roller 70 and supported by the supporting member 90. The supporting member 90 is fixed by being fit, at its longitudinal opposite ends, into mounting holes 53 defined in the side plates 52 that are fixed to a casing (not shown) of the fixing device. Only one of the mounting holes 53 is illustrated in FIG. 2. By being fixed in this manner, the supporting member 90 and the pad 80 are prevented from being displaced due to a pressure applied from the pressure roller 70.

Figure 6:
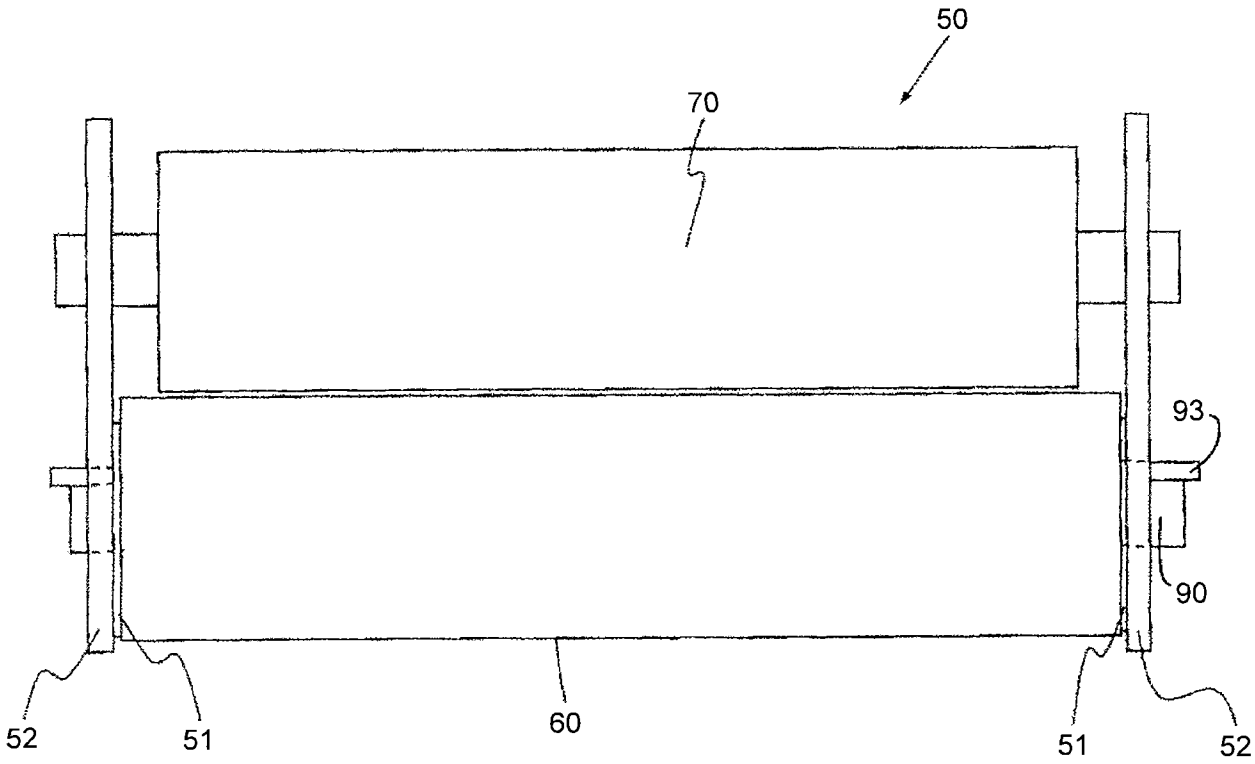
FIG. 6 is a plan view of relevant portions of the fixing device illustrated in FIG. 1.

The holders 51, which are fixing-belt holding members, are formed on the right and left side plates 52 (see FIGS. 6 and 7) such that the holders 51 face and project toward to each other. Each of the holders 51 is a curved projection shaped like a notched ring. Outer peripheral curved surfaces of the holders 51 make sliding contact with an inner wall surface of the annular fixing belt 60 on the longitudinal opposite sides, thereby reducing radial and axial rotation offset of the fixing belt 60.

It is desirable that the supporting member 90 is made of a metal material, such as stainless steel or iron, exhibiting a high mechanical strength so that the supporting member 90 can satisfactorily provide the function of preventing warping of the pad 80. More specifically, each of plate members, which will be described later, that make up the supporting member 90 is desirably manufactured by punching out a steel plate. Manufacturing the plates from a steel plate(s) allows manufacturing the supporting member 90 that is inexpensive but highly rigid.

Further description about the supporting member 90 will be given later.

Figure 5A:
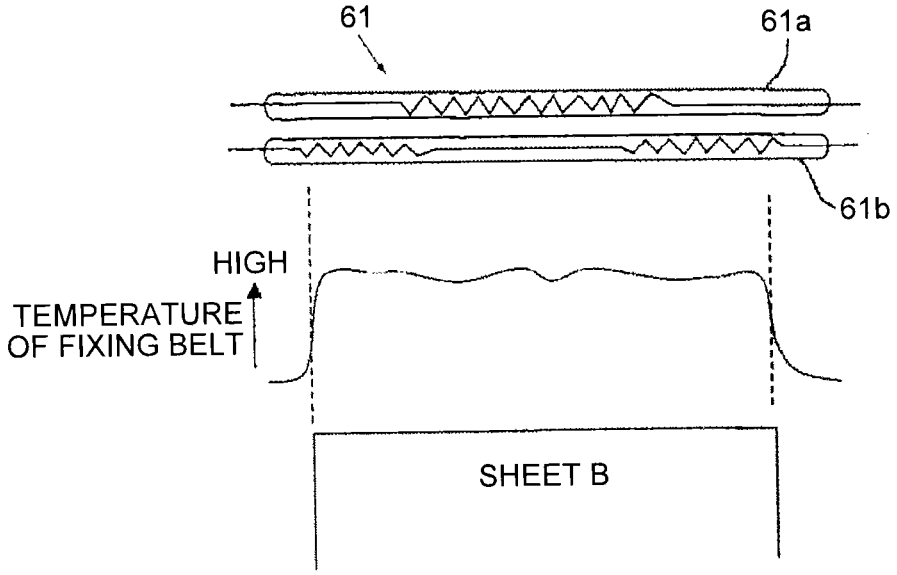
FIGS. 5A and 5B are diagrams for illustrating functions of halogen heaters of the fixing device illustrated in FIG. 1, with FIG. 5A being an explanatory diagram of an area to be heated when a wide sheet is fed, FIG. 5B being an explanatory diagram of an area to be heated when a narrow sheet is fed.
Figure 5B:
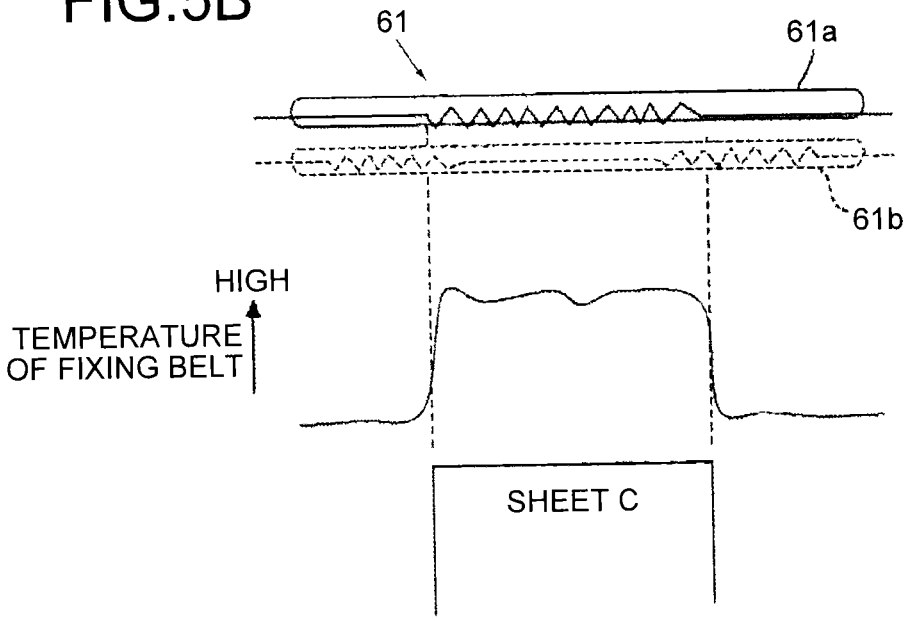

As illustrated in FIGS. 5A and 5B, a center heater 61*a* and an end heater 61*b*, which may be referred to as the halogen heaters 61, are used in a state where the two heaters are arranged parallel to each other. Hereinafter, the center heater 61*a* and the end heater 61*b* may be collectively referred to as "the halogen heaters 61". The halogen heaters 61 differ from each other in heat radiating area. Accordingly, the halogen heaters 61 can heat the fixing belt 60 differently depending on a size of a sheet of recording medium (hereinafter, "sheet") fed to the fixing device 50. More specifically, the fixing device 50 according to the first embodiment includes the two heaters, one of which is the center heater 61*a* that heats a position corresponding to a longitudinal center area of the fixing belt 60, the other one of which is the end heater 61*b* that heats positions corresponding to longitudinal end areas of the fixing belt 60. As illustrated in FIG. 5A, when a wide sheet B such as A3-size paper in portrait orientation is fed, both the center heater 61*a* and the end heater 61*b* are turned on. On the other hand, as illustrated in FIG. 5B, when a narrow sheet C such as A4-size paper in portrait orientation is fed, only the center heater 61*a* is turned on. This configuration allows reducing electric power to be consumed to heat the fixing belt 60. Although the number of the halogen heaters 61 is two in the first embodiment, as a matter of course, employable configuration of the halogen heaters 61 is not limited thereto.

The pad 80 is interposed between the fixing belt 60 and the halogen heaters 61 so as to function as a shielding member that shields heat radiated from the halogen heaters 61 at a portion (which may be an axial end portion, for example). This configuration enables reducing an excessive temperature rise particularly at an area where no sheet passes (hereinafter, "sheet-absent area") on the fixing belt 60, thereby preventing degradation and damage that would otherwise be caused by heat of the fixing belt 60. Further description about the pad 80 will be given later.

Basic operations of the fixing device 50 according to the first embodiment are described below.

When a power switch (not shown) on the printer body is turned on, electric power is supplied to the halogen heaters 61 and, simultaneously, the pressure roller 70 starts rotating clockwise in FIG. 2. Accordingly, frictional force exerted between the fixing belt 60 and the pressure roller 70 causes the fixing belt 60 to be rotated counterclockwise in FIG. 2 by rotation of the pressure roller 70.

Thereafter, the sheet P (see FIG. 2), which is an image bearer, where an unfixed toner image T formed through the image forming sequence described above is conveyed in a direction indicated by an arrow A1 in FIG. 2 by being guided by guide plates (not shown). The sheet P is delivered into the nip area N formed in a nip zone where the pressure roller 70 is pressed against the fixing belt 60 by a pressing mechanism. Then, the toner image T is fixed onto a surface of the sheet P by heat applied from the fixing belt 60 heated by the halogen heater(s) 61 and a pressing force exerted between the fixing belt 60 and the pressure roller 70.

The sheet P where the toner image T is fixed is conveyed out of the nip area N in the direction indicated by the arrow A1 in FIG. 2. At this time, the leading end of the sheet P is brought into contact with the leading end of a separation member 75 supported by the side plates 52, causing the sheet P to be separated from the fixing belt 60. Thereafter, as described earlier, the separated sheet P is ejected out of the apparatus by the paper ejection rollers into the paper ejection tray to be stacked thereon.

The pad 80, which is the nip forming member, supported by the supporting member 90 is described below.

Figure 3A:
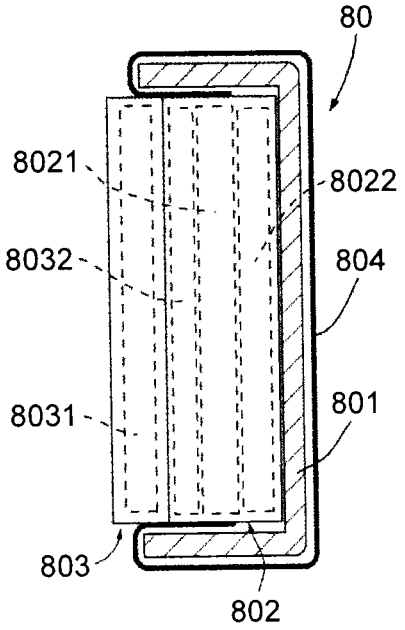
FIGS. 3A and 3B are diagrams for describing a pad used in the fixing device illustrated in FIG. 1, with FIG. 3A being a schematic cross-sectional view, FIG. 3B being a cutaway perspective view of the pad from which first and second layers are removed.
Figure 3B:
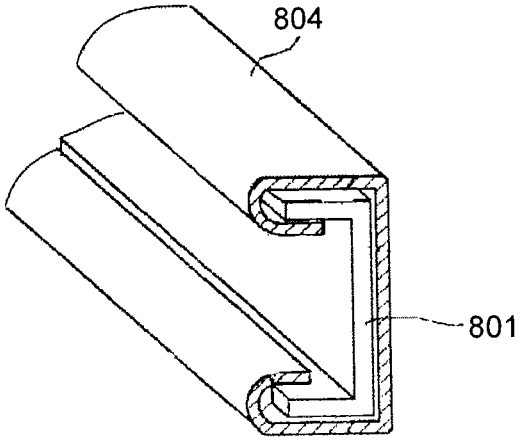

As illustrated in FIGS. 3A and 3B, the pad 80 has a four-layer structure made up of a pad surface 801 (a heat transfer member on a first layer), a pad middle 802 (a heat transfer member on a second layer), a pad lining 803 (a heat transfer member on a third layer), and a sliding sheet 804.

As illustrated in FIG. 3A, the pad surface 801, which is the heat transfer member on the first layer, of the pad 80 is made of metal, functions as a heat equalizing layer, and is covered by the sliding sheet 804. As illustrated in FIG. 3A, end portions in a sliding direction of the sliding sheet 804 are held by being pinched by the pad middle 802 and the pad lining 803 so that the sliding sheet 804 is fixed firmly. This configuration allows the fixing belt 60 to slide over the sliding sheet 804 when the fixing belt 60 is rotated, thereby reducing a drive torque developed in the fixing belt 60 and a frictional load exerted on the fixing belt 60.

Figure 4:
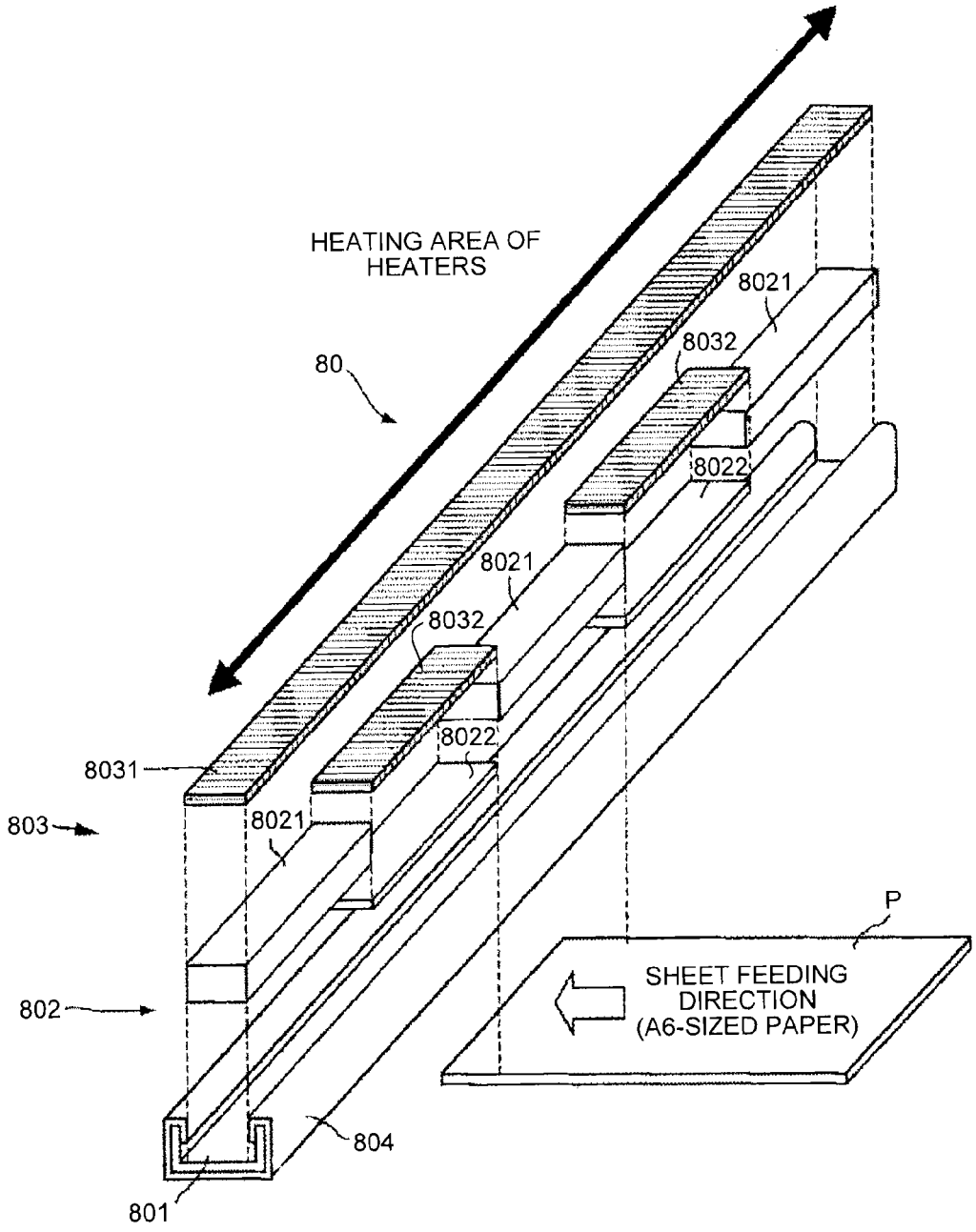
FIG. 4 is an enlarged exploded view of the pad of the fixing device illustrated in FIG. 1.

As illustrated in FIG. 4, the pad surface 801 of the pad 80 has the function of equalizing heat on the fixing belt 60 by facilitating heat transfer in the longitudinal direction (which is obliquely perpendicular to the paper plane of FIG. 4) of the pad 80, thereby reducing a temperature rise at the sheet-absent area (hereinafter, "sheet-absent-area temperature rise").

By contrast thereto, the pad lining 803 that is made of metal and in contact with the supporting member 90 includes a first heat-absorbing member 8031. The first heat-absorbing member 8031 is a heat absorbing layer made of metal. It is desirable that the first heat-absorbing member 8031 has a large heat capacity and, to increase the amount of heat to be dissipated, a large surface area.

The pad middle 802 between the heat equalizing layer and the heat absorbing layer includes a second heat-absorbing member 8032, a first heat-insulating member 8021, and a second heat-insulating member 8022 and functions as a corrective heat transfer layer. The second heat-absorbing member 8032, which is arranged in patches, provides a function of facilitating heat transfer in the thickness direction and absorbing heat. In short, the first heat-absorbing member 8031 makes up for shortage in heat capacity of the pad surface 801.

The first heat-insulating member 8021 adjacent to the first heat-absorbing member 8031 is made of a material, e.g., resin, that is lower in heat conductivity than the pad surface 801. The first heat-insulating member 8021 extends in the longitudinal direction of the fixing belt 60 in a patchy manner to be disposed between the pad surface 801 and the first heat-absorbing member 8031 at positions where the second heat-absorbing member 8032 is not provided (see FIG. 4). The first heat-insulating member 8021 configured in this way prevents an excess in absorbing heat radiated from the fixing belt 60. As a result, temperature drop at an area where a sheet passes on the fixing belt 60 can be prevented. Furthermore, reduction in warm-up time and electric power consumption can be achieved.

The second heat-insulating member 8022 is made of a material, e.g., resin, that is lower in heat conductivity than the pad surface 801 and interposed between the pad surface 801 and the second heat-absorbing member 8032. The second heat-insulating member 8022 allows reduction in amount of heat transferred from the pad surface 801 to the second heat-absorbing member 8032.

If the thickness of the second heat-insulating member 8022 is excessively large, transfer of heat accumulated in the fixing belt 60 to the second heat-absorbing member 8032 will be inhibited, thereby making the sheet-absent-area temperature rise likely to occur. For this reason, the length of each patch and the thickness of the second heat-insulating member 8022 are desirably optimized depending on the sheet-absent-area temperature rise. The thickness of the second heat-insulating member 8022 is to be smaller than that of the first heat-insulating member 8021.

The first heat-absorbing member 8031 is made of a material, e.g., metal, that is higher in heat conductivity than the pad middle 802 (the second heat transfer member). The first heat-absorbing member 8031 extends in the longitudinal direction of the fixing belt 60 and is positioned to face the first heat-insulating member 8021 and the second heat-insulating member 8022.

As described earlier, the pad middle 802, which is the second layer arranged in contact with the first layer, includes the second heat-absorbing member 8032. The pad 80 thus includes, at a part corresponding to a position where the sheet-absent-area temperature rise occurs in the axial direction of the fixing belt 60, the member that facilitates heat transfer as compared with the other part. As a result, the sheet-absent-area temperature rise is reduced, and therefore the fixing belt 60 can have durability and temperature stability.

The supporting member 90 that supports the pad 80 is described below.

Figure 11A:
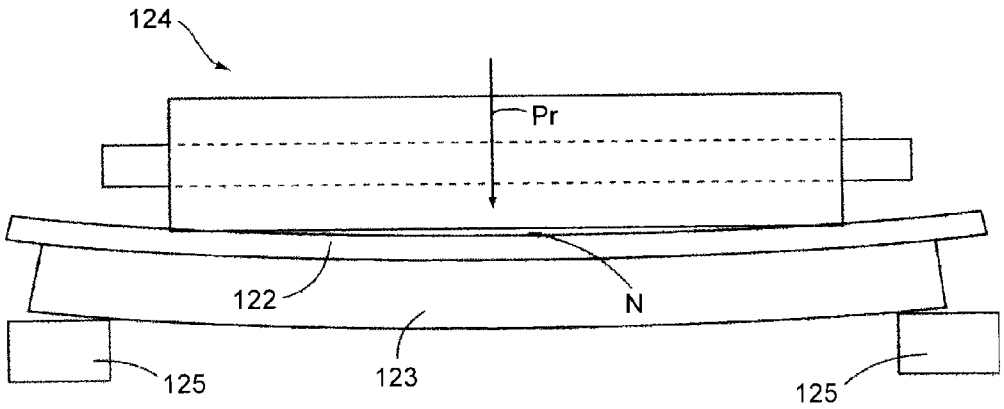
FIGS. 11A and 11B are diagrams illustrating, for reference purpose, a supporting member of the conventional fixing device, with FIG. 11A being a side view of the supporting member that is deformed, FIG. 11B being an explanatory diagram of a nip width of the supporting member that is deformed.
Figure 11B:
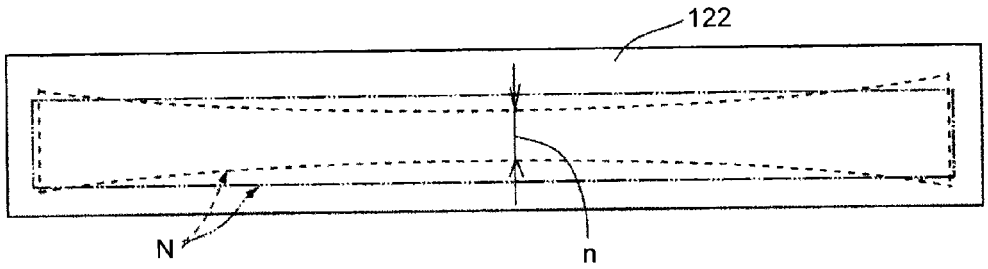

The supporting member 90 that provides the function of compensating for variation of the width n of the nip area N (see FIGS. 11A and 11B) in the longitudinal direction of the pad 80 that occurs when the pressure roller 70 is pressed against the pad 80, which is the nip forming member, is described below with reference to FIGS. 6 to 8B.

As illustrated in FIG. 2, the supporting member 90 according to the first embodiment is fixed to the apparatus body in one piece therewith. This fixation is done by defining the mounting holes 53 (only one of which is illustrated in FIG. 2) in the right and left side plates 52 arranged to face each other, and fitting the longitudinal opposite ends of the supporting member 90 into the mounting holes 53.

The supporting member 90 supported at its both ends by the side plates 52 is configured to support, on its primary longitudinal area, the pad 80 in one piece therewith and receive the pressing force Pr applied to the pad 80 from the pressure roller 70 via the fixing belt 60 as a fixed-ends beam as illustrated in FIG. 7.

More specifically, as illustrated in FIG. 2, the supporting member 90 receives the pressing force Pr at a plurality of load input portions g1 on the end where the supporting member 90 faces the pad 80, and transfers the pressing force Pr to edges of the right and left mounting holes 53 defined in the right and left side plates 52 via load output portions g2.

The supporting member 90 is formed by combining a flat plate-like upper stay 91, a curved plate-like lower stay 92, and a vertical flat plate-like stay (hereinafter, simply referred to as "vertical stay") 93 on the right side into one piece that is triangular in side view.

Furthermore, the upper stay 91 and the lower stay 92 of the supporting member 90 are overlaid on one another and joined together at an overlaid-end portion on the left side in FIG. 2. A plurality of fitting projections 905 on the vertical stay 93 are fit into and riveted through the upper stay 91 and the lower stay 92 on the side opposite from the overlaid-end portion. The vertical stay 93 is orthogonal to the upper stay 91 and the lower stay 92 on the right side in FIG. 2. As illustrated in FIG. 8B, the plurality of fitting projections 905 are arranged in two rows spaced from each other in the direction in which the stays are spaced (in the vertical direction in FIG. 2).

This configuration makes a length L1 between end faces of the two plate members that make up the supporting member 90 in the lateral direction (the horizontal direction in FIG. 2) uniform, thereby allowing the supporting member 90 to have a simple shape. This leads to an increase in accuracy in assembling the nip supporting member. Furthermore, because the nip supporting member can be assembled with high accuracy while being joined rigidly, structural rigidity as a fixed-ends beam can be obtained.

In the first embodiment, a warping amount δ (see FIG. 7) of warping deformation of the supporting member 90 when the pressing force Pr is applied to the supporting member 90 serving as the fixed-ends beam is determined in advance. A plurality of engaging tabs t1 and t2 at a center portion projects toward the pad 80 by distances that allow compensating for the warping amount δ. Projecting support surfaces k1 and k2 are formed by the engaging tabs t1 and t2, respectively.

Figure 8A:
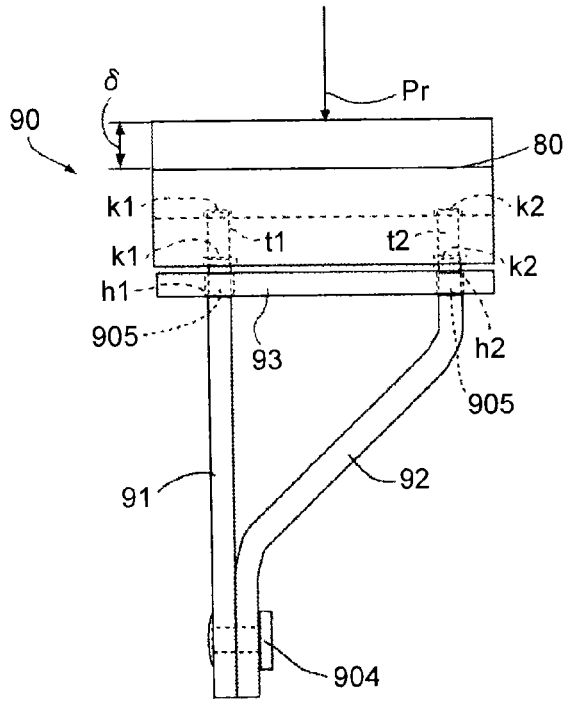
FIGS. 8A and 8B are diagrams illustrating a supporting member used in the fixing device illustrated in FIG. 1, with FIG. 8A being a side view, FIG. 3B being a cutaway perspective view of relevant portions of the supporting member.
Figure 8B:
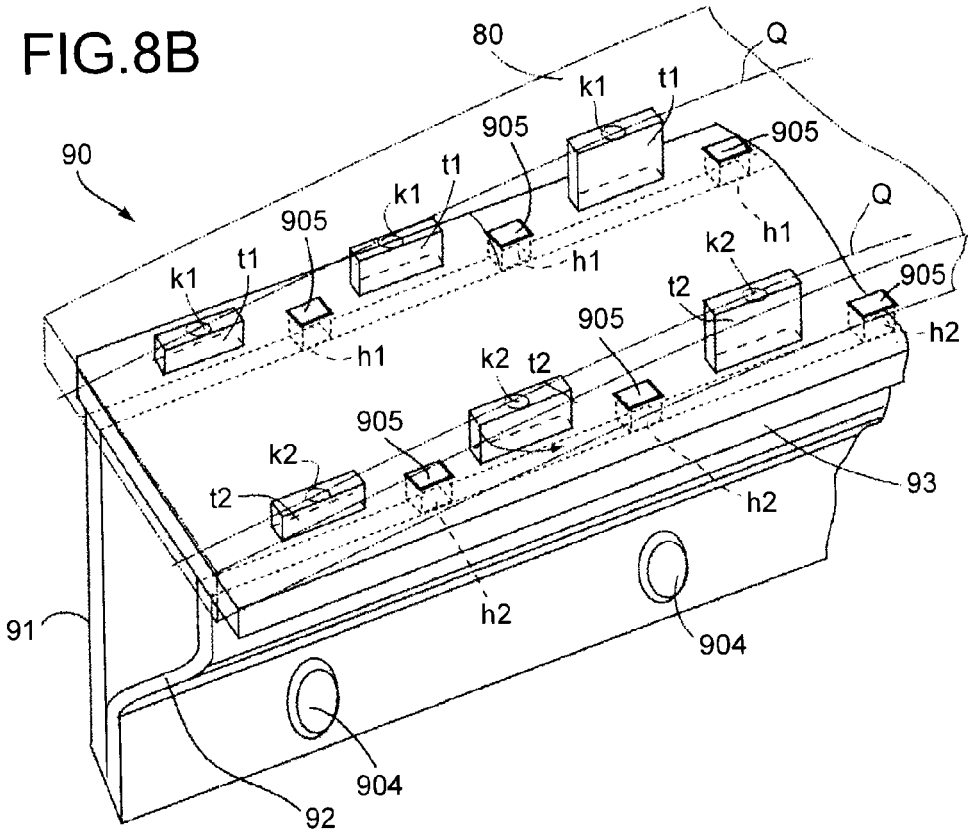

More specifically, as illustrated in FIGS. 8A and 8B, the supporting member 90 is formed by riveting the upper stay 91 and the lower stay 92 together at the overlaid-end portion on the side opposite from the pad 80 with rivets 904. The upper stay 91 and the lower stay 92 are respectively butted against the vertical stay 93 on the side of the pad 80 (FIG. 8B), where the upper stay 91 and the lower stay 92 are apart from each other, opposite from the overlaid-end portion. The fitting projections 905 of the upper stay 91 and the lower stay 92 are caused to pass through rectangular through holes h1 and h2, which are defined in the vertical stay 93 in advance. Each pair of one of the fitting projections 905 and a corresponding one of the through holes h1 and h2 is rectangularly fitted and riveted together.

The two rows of the discretely-arranged plurality of fitting projections 905 are formed on the vertical stay 93 in this manner. The two rows are parallel to each other and apart in the lateral direction of the stays. Furthermore, the engaging tabs t1 project from midpoints between each adjacent pair of the fitting projections 905 on one of the rows, and the engaging tabs t2 project in a similar manner on the other row.

Two parallel curved lines Q, one of which connects the projecting support surfaces k1 of the engaging tabs t1 of one of the rows and the other of which connects the projecting support surfaces k2 of the engaging tabs t2 of the other row, are curved with respect to the longitudinal direction of the stays (hereinafter, "stay longitudinal direction"). More specifically, as illustrated in FIG. 7, projecting ends of the engaging tabs t1 and t2 on the vertical stay 93 are shaped so that the two parallel curved lines Q (only one of which is illustrated in FIG. 7) are curved with respect to the stay longitudinal direction.

Furthermore, each of the curved lines Q protrudes toward the pressure roller 70 and the pad 80 most at its center portion in the longitudinal of the supporting member 90. Each of the projecting support surfaces k1 and k2 on the projecting ends of the engaging tabs t1 and t2 functions as a leg that supports the pad 80.

As described above, the projecting ends of the plurality of engaging tabs t1 and t2 (only one of which is illustrated) projecting from the vertical stay 93 (which lies horizontally in FIG. 8A) toward the pad 80 form the curved lines Q that are curved in the shape protruding with respect to the stay longitudinal direction.

In the first embodiment, the warping amount δ for compensating for warping deformation of the supporting member 90 that occurs when the pressing force Pr is applied to the supporting member 90 serving as the fixed-ends beam is determined in advance. The two curved lines Q, which are defined by the projecting ends of the engaging tabs t1 and t2 (only one of which is illustrated), are determined based on the warping amount δ. The supporting member 90 is formed so that the plurality of engaging tabs t1 and t2 project by distances that allow obtaining the curved lines Q determined based on the warping amount δ.

Accordingly, in the first embodiment, accuracy of the shape of the center protrusion of the supporting member 90 is controllable by controlling the engaging tabs t1 and t2 that define the two curved lines Q. By virtue that a control range can be limited, manufacture of the nip supporting member is facilitated.

Furthermore, the engaging tabs t1 and t2 to be inserted through and fixed to the rectangular through holes h1 and h2, respectively, are discretely arranged in the rows along the stay longitudinal direction. Therefore, contact surfaces between the engaging tabs t1 and t2 and the pad 80 are discrete. Because a state of contact between each of the engaging tabs t1 and t2 and the pad 80 is individually adjustable, accuracy of the shape of the center protrusion of the supporting member 90 is controllable also through this adjustment. By virtue that the control range can be limited, manufacture of the nip supporting member is facilitated.

How the fixing device 50 operates when driven is described below.

As described earlier, the supporting member 90 assumes the shape protruding at the center portion in the stay longitudinal direction than at the end portions by the projecting amount δ (see FIG. 7) in a state where the pressing force Pr is not applied to the supporting member 90. Assume that the fixing device 50 is driven in this state.

The pressing force Pr is applied from the pressure roller 70 to the pad 80 and the supporting member 90 via the fixing belt 60. Thereafter, the center portion of the supporting member 90 that receives the pressing force Pr is deformed in the direction away from the pressure roller 70. Thereafter, the supporting member 90 brought into contact with the pressure roller 70 is warped in a manner to make the pad 80 assuming the shape protruding at the center and the curved lines Q of the projecting support surfaces k1 and k2 of the plurality of engaging tabs t1 and t2 on the supporting member 90 substantially straight so as to compensate for the projecting amount 6. In this state, a resilient restoring force of the supporting member 90 and the pressing force Pr are balanced against each other.

Elastic displacement of the supporting member 90 is compensated for by the curved lines Q of the projecting support surfaces k1 and k2 of the engaging tabs t1 and t2 in this manner. Accordingly, even if the pad 80 is warped by the pressing force Pr, because the supporting member 90 is deformed away from the pressure roller 70 enough to compensate for the warping amount δ, the pad 80 can be supported straight. By virtue of such elastic displacement of the supporting member 90, the pad 80 (the nip forming member) can have the nip width n (see FIG. 11B) that is uniform in the longitudinal direction (see the long dashed double-short dashed line in FIG. 11B) with high dimensional accuracy. Accordingly, the fixing device can provide stable fixing quality; the image forming apparatus can produce printouts of stable image quality.

The fixing device 50 is configured to cause the pad 80, which is the nip forming member, to provide the function as the heat transfer layer. When configured as such, it is difficult to impart a protruding shape, which allows compensating for warping, to the pad 80. However, according to the first embodiment, because the function of compensating for warping by being deformed by a pressing force is provided to the supporting member 90 rather than to the pad 80, the pad 80 can be configured to move simply in one piece with the supporting member 90. Because the pad 80 can be warped even with this configuration, the pad 80 can have the nip width that is uniform in the longitudinal direction of the pad 80 with high dimensional accuracy. Hence, the embodiment can be effectively utilized.

In the fixing device 50 described above, the two plate members, which are the upper stay 91 and the lower stay 92, making up the supporting member 90 are joined together by riveting. Accordingly, the two plate members, which are the upper stay 91 and the lower stay 92, can be joined inexpensively.

Furthermore, in the fixing device 50 described above, the curved lines Q are defined by the projecting support surfaces k1 and k2 of the engaging tabs t1 and t2. Accordingly, even if the supporting member 90 is warped by the pressing force Pr, the warping amount δ is compensated for, and the pad 80 is supported straight. Hence, the pad 80 (the nip forming member) can have the nip width n (see FIG. 11B) that is uniform in the longitudinal direction (see the long dashed double-short dashed line in FIG. 11B) with high dimensional accuracy. As a result, the fixing device can provide stable fixing quality.

Furthermore, the fixing device 50 capable of maintaining the nip width n uniform in the longitudinal direction is also advantageous for reduction in first print time, which is the time lapse from a heating-standby mode, and alleviating the problem of heat shortage that can occur when the number of fed sheets per unit time is large. Even when mounted on a high-productivity image forming apparatus, the fixing device 50 can provide favorable fixing quality.

Although the first embodiment has been described above, embodiments of the invention are not limited thereto.

Figure 9:
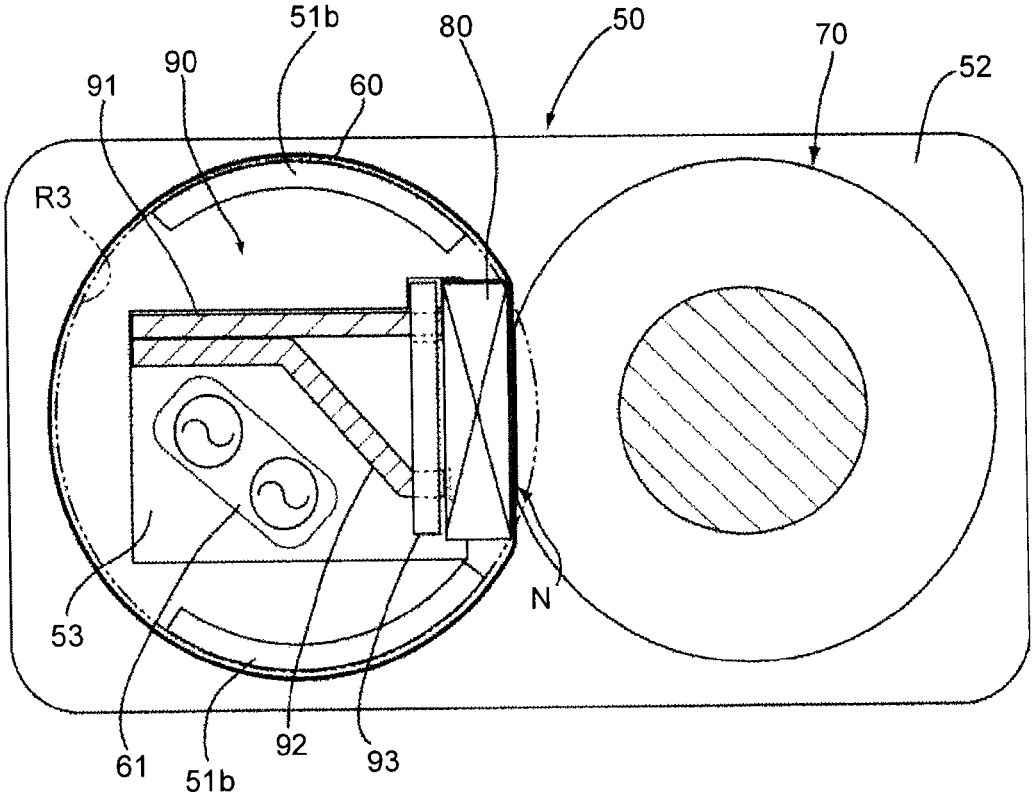
FIG. 9 is a cross-sectional view schematically illustrating relevant portions of a fixing device according to a second embodiment of the present invention.
Figure 10:
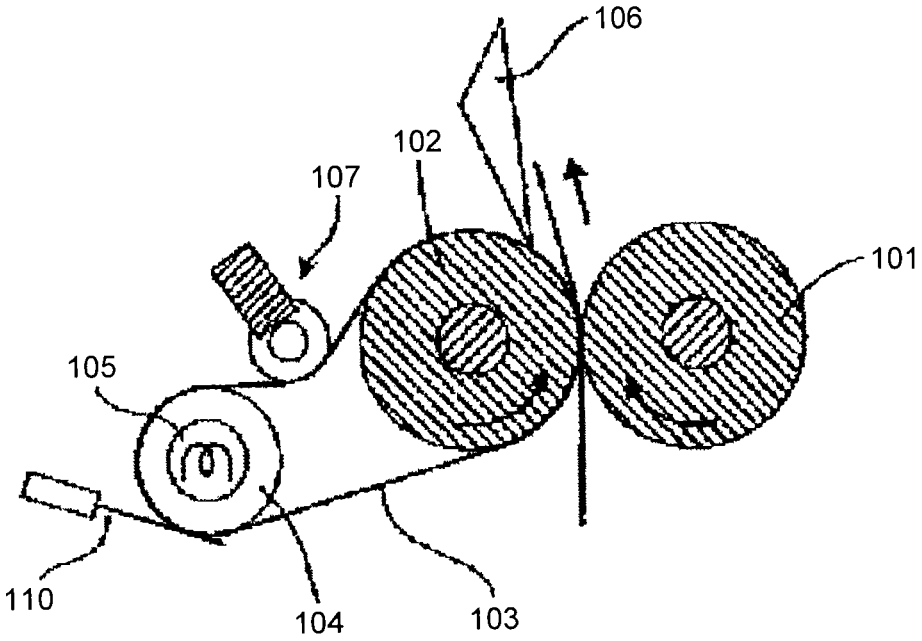
FIG. 10 is an explanatory diagram of a conventional fixing device.

The fixing device of the first embodiment employs the holders 51 each shaped like a notched ring. To simplify the shape, a second embodiment may be configured such that the fixing belt is rotatably supported by a plurality of holder pieces 51*b* arranged along a rotation trajectory R3 of an inner peripheral wall of the fixing belt as illustrated in FIG. 9. Elements of the second embodiment except for the holder pieces 51*b* are identical to those of the fixing device 50 of the first embodiment, and therefore repeated description is omitted. The second embodiment can provide similar advantages as those of the first embodiment.

In the fixing device 50 illustrated in FIG. 2, the upper stay 91 and the lower stay 92 making up the supporting member 90 are riveted together at the overlaid-end portion on the side opposite from the pad 80 with the rivets 904, while the upper stay 91 and the lower stay 92 on the side of the pad 80 are butted against the vertical stay 93 and riveted thereto. However, depending on occasions, the upper stay 91, the lower stay 92, and the vertical stay 93 may be mutually welded rather than riveted. Joining the stays by welding increases strength of joints in the supporting member 90, so that the nip supporting member that is less easily warped can be manufactured.

The image forming apparatus 10 embodied as the color printer described above includes the fixing device 50. Accordingly, the image forming apparatus 10 uses the supporting member 90 that can achieve an accurately-uniform nip width while being manufactured with less processing difficulty. Because nip positional accuracy can be stabilized inexpensively, an image forming apparatus providing similar advantages to those provided by the fixing device 50 can be obtained.

In the first embodiment, the pad 80 includes the first to fourth heat transfer members, in which the first heat transfer member is the heat equalizing member. However, the function provided by the first heat transfer member is not limited to heat equalization. The first heat transfer member may alternatively provide the function of heat absorption, heat insulation, or the like. Each of the third and fourth heat transfer members may additionally provide the function of heat absorption and heat insulation.

The fixing device according to an embodiment of the present invention has been described as being mounted on the image forming apparatus 10 embodied as the color printer. However, the image forming apparatus where the fixing device is to be mounted is not limited to the type described above, but may be of another type. The image forming apparatus to which an embodiment of the present invention is applied may be, for example, a copier machine, a facsimile machine, a multifunction peripheral having a plurality of mechanisms of such machines. The image forming apparatus to which an embodiment of the present invention is applied may be, for example, an image forming apparatus for use in forming electric circuits or an image forming apparatus for use in forming desired images in the field of biotechnology.

According to an aspect of the present embodiments, a nip supporting member assumes a shape protruding at a longitudinal center portion than at longitudinal end portions. Accordingly, the nip supporting member can compensate for warping of a nip forming member, which is supported by the nip supporting member, even when the nip forming member is warped by a pressing force. Hence, the nip forming member can have a uniform nip width in the longitudinal direction with high dimensional accuracy.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

an endless fixing belt;

fixing-belt holding members configured to hold the fixing belt at opposite ends of the fixing belt;

a pressure member configured to be brought into contact with an outer peripheral surface of the fixing belt;

a nip forming member arranged inside the fixing belt and configured to form a nip area by contacting the pressure member with the fixing belt;

a nip supporting member configured to support the nip forming member;

side plates to which the fixing-belt holding members and the nip supporting member are fixed; and a pressing mechanism configured to press the pressure member against the nip forming member with the fixing belt therebetween, the nip forming member being formed by at least three layers including a heat absorbing layer, the heat absorbing layer being made of metal and in contact with the nip supporting member, and in a state where no load is applied to the nip supporting member, the nip supporting member including a shape protruding more at a longitudinal center portion than at longitudinal end portions toward the pressure member, the nip supporting member being in contact with the nip forming member, and the nip forming member including a shape protruding more at a longitudinal center portion than at a longitudinal end portions toward the pressure member.

2. The fixing device according to claim 1, wherein the nip forming member includes at least three heat transfer layers including a heat absorbing layer, a heat equalizing layer in contact with the fixing belt, and a corrective heat transfer layer between the heat absorbing layer and the heat equalizing layer.

3. The fixing device according to claim 1, wherein the shape of the nip supporting member protruding at the longitudinal center portion is made up of two rows extending along the longitudinal direction.

4. The fixing device according to claim 1, wherein contact surfaces between the nip supporting member and the nip forming member are discrete.

5. The fixing device according to claim 1, wherein a second layer of the at least the three layers arranged in contact with a first layer of the at least the three layers includes a member at a part of the second layer in an axial direction, the member facilitating heat transfer as compared with the other part, the part corresponding to a position where a sheet-absent-area temperature rise occurs on the fixing belt.

6. The fixing device according to claim 5, wherein a third layer of the at least the three layers arranged in contact with the second layer is made of metal.

7. An image forming apparatus comprising the fixing device of claim 1.

* * * * *